US006652092B2

(12) United States Patent
Sugiyama et al.

(10) Patent No.: US 6,652,092 B2
(45) Date of Patent: Nov. 25, 2003

(54) RECORDING SHEET FOR INK JET PRINTER

(75) Inventors: Jun Sugiyama, Nagano-ken (JP); Fumikazu Tatsuhashi, Shizuoka-ken (JP); Nobuhiro Kubota, Shizuoka-ken (JP); Minoru Tsuchida, Shizuoka-ken (JP)

(73) Assignees: Seiko Epson Corporation, Tokyo (JP); Tomoegawa Paper Co., Ltd, Tokyo (JP)

( * ) Notice: Subject to any disclaimer, the term of this patent is extended or adjusted under 35 U.S.C. 154(b) by 0 days.

(21) Appl. No.: 10/175,150

(22) Filed: Jun. 20, 2002

(65) Prior Publication Data

US 2003/0008115 A1 Jan. 9, 2003

(30) Foreign Application Priority Data

Jun. 21, 2001 (JP) ..... 2001-188668
Jun. 19, 2002 (JP) ..... 2002-178049

(51) Int. Cl.[7] ..... B41J 2/01
(52) U.S. Cl. ..... 347/105; 347/101; 428/195
(58) Field of Search ..... 347/105, 101; 428/195; 346/135.1

(56) References Cited

U.S. PATENT DOCUMENTS 4,403,232 A * 9/1983 Kropac ..... 347/105
5,576,088 A * 11/1996 Ogawa et al. ..... 347/105
6,350,507 B1 * 2/2002 Iwamoto et al. ..... 428/195

FOREIGN PATENT DOCUMENTS

JP 61-063477 4/1986
JP 06-183134 * 7/1994 ..... B41M/5/00
JP 08-169177 7/1996

* cited by examiner

*Primary Examiner*—Stephen D. Meier
*Assistant Examiner*—Manish Shah
(74) *Attorney, Agent, or Firm*—Arent Fox Kintner Plotkin & Kahn, PLLC

(57) ABSTRACT

A superior recording sheet for an ink jet printer which sufficiently satisfies various property requirements such as light resistance of images, ozone resistance, etc., is provided. The recording sheet for an ink jet printer comprises at least an ink receiving layer and a glossiness adjusting layer on a base material, the ink receiving layer includes an organic acid metallic salt and a cationic dye fixing agent, and the glossiness adjusting layer comprises a fine particle pigment and binder resin.

6 Claims, No Drawings

RECORDING SHEET FOR INK JET PRINTER

FIELD OF THE INVENTION

The present invention relates to a recording sheet, and in particular, relates to a recording sheet for an ink jet printer, in which printing density is high; printing is vivid; ink absorptivity is superior; light resistance, ozone resistance, shelf-life indoors, yellowing prevention and water resistance are superior; fading and changing of color tone in direct sunlight can be avoided; and ink is quickly absorbed. The recording sheet satisfies future high speed printing technique requirements.

BACKGROUND ART

The use of ink jet printers is further increasing in recent years since they have characteristics such as vividness of recorded images, quiet operation, ease of coloring, and the like. In order to prevent the jet nozzle thereof from being blocked due to drying of ink, an ink which is difficult to dry must be used in the ink jet printers. As ink having this property, water-soluble ink which is dissolved or dispersed with adhesive, dye, solvent, additives, or the like, in water, is generally employed. However, a letter or an image formed on the recording sheet by employing the water-soluble ink is inferior to that of printed matter or silver halide photographs due to the use of pigment-type inks, from the viewpoint of light resistance, shelf-life indoors, water resistance, and resistance to direct sunlight.

In recent years, as ink jet printers become less expensive and printing images having high glossiness like photographs can be obtained so that high vividness and colorfulness thereof is anticipated, the requirements for various properties such as light resistance, ozone resistance, etc., are becoming severe. Therefore, completely satisfying these various requirements such as light resistance, ozone resistance, etc., is an essential goal for recording sheets for ink jet printers.

In consideration of this present situation, improvement of the light resistance of recording sheets for ink jet printers is being studied. Many patent applications, for example, typified by Japanese Patent Publication No. 4(92)-15745, proposes adding metallic compounds such as magnesium oxide, magnesium carbonate, calcium oxide, calcium carbonate, or the like to improve light resistance. However, it has been confirmed that an improvement in light resistance by merely adding these metallic compounds is not sufficient, and a drawback is that a decrease in vividness of images results. Additionally, with regard to conventional methods of improving yellowing prevention of recording sheets for ink jet printers, many patents, for example, typified by Japanese Patent Application Publication No. 8(96)-169177, are applied for. However, these improvements are not yet sufficient, and a recording sheet for ink jet printer having superior yellowing prevention has not yet been put to practical use.

Furthermore, with regard to light resistance, resistance to indoor light has been studied; however, preventive methods for fading and changing of color tone in direct sunlight have not been researched sufficiently. In addition, with regard to ozone resistance, almost no research has been carried out.

DISCLOSURE OF THE INVENTION

It is an object of the present invention to provide a superior recording sheet for an ink jet printer which sufficiently satisfies various property requirements such as light resistance of images, ozone resistance, etc.

According to the results that the inventors have obtained from various research with regard to a recording sheet for an ink jet printer, the various properties, such as the light resistance of images, ozone resistance, etc., are improved very effectively by including an organic acid metallic salt in the recording sheet for an ink jet printer, and the inventors have thereby attained the present invention. In other words, the recording sheet for an ink jet printer according to the present invention is characterized in that at least an ink receiving layer and a glossiness adjusting layer are provided on a base material by laminating in this order, the recording sheet for an ink jet printer includes an organic acid metallic salt and a cationic dye fixing agent, and the glossiness adjusting layer comprises a fine particle pigment and binder resin. In the following, the preferred embodiments according to the present invention will be explained in detail.

BEST MODE FOR CARRYING OUT THE INVENTION

The recording sheet for an ink jet printer according to the present invention is a lamination in which is provided at least one ink receiving layer on at least one surface of a base material by a providing means such as a coating method, or the like. The ink receiving layer may be provided as two layers or more. In the following, materials which consist of a base material and an ink receiving layer will be explained.

(1) Base Material

As a base material provided for coating an ink receiving layer according to the present invention, a base paper which is mixed wood pulp such as chemical pulp such as LBKP, NBKP, or the like; mechanical pulp such as GP, PGW, RMP, TMP, CTMP, CMP, CGP, or the like; recycled pulp such as DIP, or the like; etc.; or synthetic fiber pulp such as polyethylene fiber, or the like, as a primary component, with pigment, sizing agent, fixer, yield improving agent, strengthening agent, or the like, alone or in combination, as necessary, and produced by using any type of apparatus such as a fourdrinier paper machine, cylinder paper machine, twin wire paper machine, or the like; can be preferably employed. In addition, a base paper provided with starch, polyvinyl alcohol, or the like using a size press; and a coated paper such as art paper, coated paper, cast coat paper, or the like, in which a coat layer is provided on these base papers, can be preferably employed. These base papers and coated papers may provide an ink receiving layer directly, and in order to control smoothness of the paper, a calender apparatus may be used such as a machine calender, TG calender, soft calender, or the like, before coating the ink receiving layer.

As a base material, a polyolefin resin layer may be provided on the surface of the above-described base paper, and synthetic resin such as polyethylene, polypropylene, polyester, nylon, rayon, polyurethane, or the like; film material comprised of a mixture with these; and fiber-formed sheets of these synthetic resins may be employed.

(2) Ink Receiving Layer (A) Pigment

In an ink receiving layer according to the present invention, generally used pigments which are insoluble or slightly soluble in water can be employed alone or in combination. For example, a white inorganic pigment such as precipitated calcium carbonate, heavy calcium carbonate, kaolin, talc, calcium sulfate, barium sulfate, titanium dioxide, zinc oxide, zinc sulfide, zinc carbonate, satin white, aluminum silicate, diatomite, calcium silicate, magnesium silicate, synthetic amorphous silica, colloidal silica, colloidal alumina, pseudo-boehmite, aluminum hydroxide, alumina, lithopone, zeolite, hydrolytic halloysite, magnesium carbonate, magnesium hydroxide, or the like; an organic pigment such as styrene-type plastic pigment, acrylic-type plastic pigment, polyethylene, microcapsules, urea resin, melamine resin, or the like, etc., can be employed.

Of these pigments, as white pigment which is a primary component contained in an ink receiving layer, a porous inorganic pigment is preferable since drying properties and absorptivity of an ink for an ink jet printer is excellent. For example, porous synthetic amorphous silica, porous magnesium carbonate, porous alumina, or the like, are preferably employed. Of these, since both printing quality and shelf-life (shelf-life indoors or in direct sunlight) are satisfied in the present invention, the precipitation type or the gel type of porous synthetic amorphous silica with a specific surface of about 200 to 600 g/m$^2$ can be preferably employed.

(B) Binder Resin

As binder resin contained in an ink receiving layer according to the present invention, polyvinyl alcohol, silyl modified polyvinyl alcohol, vinyl acetate, oxidized starch, etherificated starch, casein, gelatin, soybean protein; cellulosic derivative such as carboxymethyl cellulose, hydroxyethyl cellulose, or the like; conjugate diene type copolymer latex such as maleic anhydride resin, styrene-butadiene type copolymer, methylmethacrylate-butadiene copolymer, or the like; acrylic type polymer latex such as (meth)acrylic acid ester polymer, (meth)acrylic acid ester copolymer, or the like; vinylic type polymer latex such as ethylene-vinylacetate copolymer, or the like; functional group modified polymer latex comprised of monomer including functional groups such as carboxy group, or the like of all types of these polymers; water-soluble adhesive consisting of thermosetting synthetic resin such as melamine resin, urea resin, or the like; synthetic resin type adhesive such as polymethylmethacrylate, polyurethane resin, unsaturated polyester resin, vinylchloride-vinylacetate copolymer, polyvinylbutyral resin, alkyd resin, or the like, can be preferably employed. These can be employed alone or in combination. The compounding ratio of the pigment to the binder resin in the ink receiving layer is preferably 1:1 to 15:1, and is more preferably 2:1 to 10:1.

(C) Organic Acid Metallic Salt

An ink receiving layer of a general recording sheet for an ink jet printer is comprised of the above-described pigment and binder resin as primary components; however, the main feature of the present invention is that an organic acid metallic salt is additionally included in an ink receiving layer of the recording sheet for an ink jet printer. In particular, it is preferable that the organic acid metallic salt be included with a cationic dye fixing agent in an ink receiving layer since superior light resistance is obtained. Organic acid metallic salts usable in the present invention are not particularly limited, and any organic acid metallic salt consisting of a metal ion and various organic acid ions as an anion (counter ion) can be employed appropriately.

As an organic acid for constituting the organic acid metallic salt in the present invention, there is no limitation in particular, and for example, carboxylic acid compounds can be mentioned. Specifically, saturated fatty acids such as acetic acid, butyric acid, caproic acid, capric acid, lauric acid, myristic acid, palmitic acid, stearic acid, behenic acid, montanoic acid, etc., and unsaturated fatty acids such as crotonic acid, oleic acid, erucic acid, sorbic acid, linoleic acid, etc., can be employed, and these fatty acids may be straight chain molecules or branched molecules. In addition, as another carboxylic acid compound, aromatic carboxylic acids, such as benzoic acid, toluic acid, salicylic acid, and dicarboxylic acids, such as oxalic acid, succinic acid, adipic acid, sebacic acid, maleic acid, and phthalic acid, can be employed. The carboxylic acid compounds may have substituents such as a hydroxyl group, halogen, nitro group, etc., as long as the effects of the present invention are not adversely affected.

As a metal, lithium, sodium, potassium, beryllium, magnesium, calcium, strontium, barium, aluminum, gallium, indium, iron, manganese, chromium, zinc, germanium, tin, lead, bismuth, cerium, etc., can be mentioned; however, metals usable in the present invention are not limited to these metals. Of these metals, divalent metal ions or trivalent metal ions are preferable, and in particular, $Zn^{2+}$, $Mg^{2+}$ and $Ca^{2+}$ are desirable. Although compounds consisting of a combination of the above organic acids and metals can be employed appropriately as an organic acid metallic salt, in the present invention, slightly water soluble compounds, that is, compounds having a solubility of 25 g or less in 100 g of water at 20° C., are preferred, and the solubility is more preferably 0.1 mg to 20 g and most preferably 0.1 mg to 10 g. The reason that compounds having low solubility are preferred as mentioned above is believed to be that since compounds having a solubility of over 25 g in 100 g of water at 20° C. are easy to dissolve in a solvent for ink for an ink jet printer and the concentration of organic acid metallic salt near the surface of the ink receiving layer is reduced, the light resistance, which is an effect of the present invention, is not sufficiently obtained even if the compounds having a high solubility are used in the same amount as that of the compounds having low solubility. In other words, by using only a small amount of the compounds having slight solubility in water, the effects of the present invention can be obtained, it is difficult for problems to occur in the case in which the content of the organic acid metallic salt is too high as described below, and good productivity and superior ink jet recording properties are achieved. In the case of the organic acid metallic salt having a solubility less than 0.1 mg, when it is contained in an amount at which the effects of the present invention can be achieved, stability of coating material or coating property is deteriorated, and therefore problems in manufacturing occur more easily.

As an organic acid metallic salt usable in the present invention, for example, water-slightly soluble metallic salts such as oxalate, benzoate, or stearate of typical elements such as magnesium, calcium, strontium, aluminium, barium, gallium, indium, thallium, zinc, germanium, tin, lead, bismuth, or the like, can be employed in the present invention. Of these organic acid metallic salts, zinc benzoate, magnesium benzoate, calcium benzoate, zinc stearate, magnesium stearate, zinc oxalate, and calcium oxalate, have superior effects.

The content of the organic acid metallic salt relative to the total solid content of the ink receiving layer may be preferably at any ratio, and it preferably ranges from 0.1 to 30.0% by weight, it more preferably ranges from 0.5 to 25.0% by weight, and it most preferably ranges from 1.0 to 20.0% by weight. In the case in which the content is less than 0.1% by weight, effects of light resistance of images and various properties are not sufficient. In contrast, in the case in which the content is more than 30.0% by weight, light resistance and the various properties are sufficiently improved; however, further improvement is not expected, and there is some concern that stability and coating properties of the coating solution will be degraded in the manufacturing process, and that water resistance or moisture resistance will be lowered or that the strength of the ink receiving layer will be decreased, even if the ink receiving layer is uniformly formed. Furthermore, control of printing quality of ink jet images may be difficult.

(D) Other Additives

Furthermore, as other additives added to the ink receiving layer, cationic dye fixing agent, pigment dispersing agent, thickener, fluidity improving agent, defoaming agent, foam inhibitor, surface lubricant, foaming agent, penetrating agent, color dye, color pigment, fluorescent brightening agent, UV absorber, antioxidant, antiseptics, water resistant agent, hardening agent, or the like, can be blended in an appropriate ratio, as necessary.

Of these additives, in particular, the cationic dye fixing agent is preferred since it cooperates with the organic acid metallic salt and the light resistance is thereby improved. As a cationic dye fixing agent, various cationic polymers can be employed, and specifically, polyethyleneimine, salt thereof, polyvinylamine, salt thereof, polyallylamine, salt thereof, acrylamide copolymer, condensation polymer salt of secondary amine and epihalohydrin, dicyandiamide compound, etc., can be employed. Of these compounds, polyallylamine, salt thereof, condensation polymer salt of secondary amine and epihalohydrin, dicyandiamide compound, are preferable. In order to obtain light resistance and water resistance and to improve effectiveness thereof, the content of the cationic dye fixing agent to total solid in the ink receiving layer is preferably 1 to 20% by weight and is more preferably 3 to 15% by weight. In addition, the solid content of the organic acid metallic salt relative to the cationic dye fixing agent content in the ink receiving layer is preferably 4:1 to 1:4 and is more preferably 3:2 to 1:1.

The composition of the ink receiving layer according to the present invention is not limited to the above-described materials. In order to satisfy various properties such as light resistance or ozone resistance and to solve production problems such as adhesion to the base material, pigments falling off in the layer in the cutting process, or the like, the solid content of each material in the ink receiving layer is most preferably 40.0 to 60.0% of pigment (preferably silica and/or alumina) by weight, 20.0 to 40.0% of binder resin by weight, 0.1 to 30.0% of organic acid metallic salt by weight, and 0.1 to 30.0% of cationic dye fixing agent by weight.

The ink receiving layer is formed on a base material by coating the coating material which was prepared by dissolving or dispersing in water or a suitable solvent, using various kinds of apparatuses such as a blade coater, roll coater, air knife coater, bar coater, rod blade coater, size press, or the like on-machine or off-machine as appropriate. The coating weight of the ink receiving layer in the one layer type is preferably 5.0 to 30.0 g/m$^2$, and is more preferably 5.0 to 20.0 g/m$^2$. In the case of the two layer type in which is provided the first ink receiving layer on a base material and in which is provided the second ink receiving layer on the first ink receiving layer, the coating weight of the first ink receiving layer is preferably 5.0 to 30.0 g/m$^2$, and is more preferably 5.0 to 20.0 g/m$^2$.

In addition, the coating weight of the second ink receiving layer is preferably 5.0 to 15.0 g/m$^2$, and is more preferably 5.0 to 10.0 g/m$^2$. In the case in which the coating weight is below the above range, excellent ink absorptivity or fixativity is seldom obtained. In the case in which it is above the above range, problems such as powdering of the layer, decrease in productivity, increase in cost, or the like occurs. In particular, in the case in which the coating weight of the second ink receiving layer is more than 15 g/m$^2$, it is difficult for the ink to pass through to the second ink receiving layer, thereby causing blurring of ink, so that vividness of images is impaired. In this way, it is preferred that the coating weight of the ink receiving layer be controlled according to the number of the provided ink receiving layers. In the case in which two or more ink receiving layers are provided, the organic acid metallic salt may be contained in any of the ink receiving layers, or it may be contained in some of the ink receiving layers. In the case in which the organic acid metallic salt is contained in some ink receiving layers, in order to reduce the concentration difference between the layers, the content of the organic acid metallic salt contained in the layers is preferably at the same ratio. Furthermore, the coated ink receiving layer may be finished, using a calender such as a machine calender, TG calender, super calender, soft calender, or the like.

The recording sheet for an ink jet printer according to the present invention is constructed as described above, and even the construction which provided only the ink receiving layer has sufficient properties. Additionally, a glossiness adjusting layer may be provided on a surface of an ink receiving layer, using a specularity drum type cast coater, or the like, in order to obtain increased value. In the present invention, in the case in which the glossiness adjusting layer is provided on the ink receiving layer, the glossiness of the glossiness adjusting layer can be optionally adjusted. In addition, the glossiness adjusting layer can be adjusted by choosing the composition at an appropriate ratio so that the glossiness of the printed portion can be higher than that of the non-printed portion, or it can conversely be lower. In the present invention, it is preferable that the glossiness adjusting layer comprise a fine particle pigment and binder resin, since superior recording properties for ink jet printer is exhibited without deteriorating superior light resistance and ozone resistance in the ink receiving layer comprising the above composition and the desired good glossiness is achieved. As a fine particle pigment, inorganic ultrafine particles having a first particle size of 50 nm or less and preferably 10 to 40 nm and having a cohered particle size of 200 nm or less and preferably 100 to 150 nm, can be employed. Specifically, silica-type pigment, such as a colloidal silica, vapor phase method silica, alumina type pigment, such as alumina, alumina hydrate, can be preferably employed. In addition, as binder resin used in the glossiness adjusting layer, various water soluble resins usable for the ink receiving layer appropriately, and of these, in particular, polyvinyl alcohol type water soluble resin and acrylic type water soluble resin are preferred in view of superior recording properties for ink jet printer. The glossiness adjusting layer is formed by applying and drying the above fine particle pigment with the binder resin on the ink receiving layer. In the present invention, by providing the glossiness adjusting layer comprising the above composition, superior properties such as ink absorbability, coloring concentration, glossiness, etc., can be obtained, while maintaining superior light resistance and ozone resistance of the ink receiving layer.

In order to obtain superior recording properties and desired glossiness, the content of the binder resin in the glossiness adjusting layer is preferably 1 to 150 parts by weight, more preferably 3 to 50 parts by weight, and most preferably 5 to 30 parts by weight to 100 parts by weigh of the fine particle pigment. A coating volume of the glossiness adjusting layer is preferably 3 to 25 g/m$^2$, and more preferably 5 to 15 g/m$^2$.

EXAMPLES

The effects according to the present invention will be shown by explaining the Examples and the Comparative Examples. The composition ratio described in the Examples was the weight ratio of dried solid.

Example 1

As a base material, wood free paper having a basic weight of 90.0 g/m$^2$ was employed. Coating materials for an ink receiving layer and for a glossiness adjusting layer, which were obtained by dissolving and dispersing the below-described materials in water, were coated on one surface of the base material in this order, and this were dried, and an ink receiving layer and a glossiness adjusting layer were formed. Thus, a recording sheet for an ink jet printer of Example 1 according to the present invention was formed. The coating volumes of the ink receiving layer and the glossiness adjusting layer were 10.0 g/m$^2$.

Coating Material for Ink Receiving Layer

- Binder resin
  - PVA (trade name: PVA 117; produced by Kuraray Co., Ltd.), 35.0% by weight
- White pigment
  - Silica (trade name: Fineseal X37B; produced by Tokuyama Soda Co., Ltd.), 54.0% by weight
- Cationic dye fixing agent (trade name: Sumirez Resin 1001; produced by Sumitomo Chemical Co., Ltd.), 10.0% by weight
- Organic acid metallic salt
  - Zinc benzoate (produced by Wako Pure Chemical Industries, Ltd.), 1.0% by weight Coating Material for Glossiness Adjusting Layer

- Binder resin
  - PVA (trade name: Gohsenal T-330; produced by The Nippon Synthetic Chemical Industry Co., Ltd.), 40.0% by weight
- Colloidal Silica (trade name: Snowtex 30; produced by Nissan Chemical Industries, Ltd.), 60.0% by weight

Example 2

The recording sheet for an ink jet printer of Example 2 was formed in the same manner as in Example 1, consisting of binder resin, white pigment, cationic dye fixing agent at the same ratios as those of the ink receiving layer in Example 1, and zinc benzoate of 10.0% by weight in total solid content of the ink receiving layer.

Example 3

The recording sheet for an ink jet printer of Example 3 was formed in the same manner as in Example 1, consisting of binder resin, white pigment, cationic dye fixing agent at the same ratios as those of the ink receiving layer in Example 1, and zinc benzoate of 20.0% by weight in total solid content of the ink receiving layer.

Example 4

The recording sheet for an ink jet printer of Example 4 was formed in the same manner as in Example 3, except that zinc stearate (produced by Wako Pure Chemical Industries, Ltd.) was used instead of zinc benzoate in the ink receiving layer of Example 3.

Example 5

The recording sheet for an ink jet printer of Example 5 was formed in the same manner as in Example 3, except that zinc oxalate (produced by Wako Pure Chemical Industries, Ltd.) was used instead of zinc benzoate in the ink receiving layer of Example 3.

Example 6

The recording sheet for an ink jet printer of Example 6 was formed in the same manner as in Example 3, except that calcium benzoate (produced by Wako Pure Chemical Industries, Ltd.) was used instead of zinc benzoate in the ink receiving layer of Example 3.

Example 7

The recording sheet for an ink jet printer of Example 7 was formed in the same manner as in Example 3, except that magnesium benzoate (produced by Wako Pure Chemical Industries, Ltd.) was used instead of zinc benzoate in the ink receiving layer of Example 3.

Example 8

The recording sheet for an ink jet printer of Example 8 was formed in the same manner as in Example 1, except that sodium benzoate (produced by Wako Pure Chemical Industries, Ltd.) was used instead of zinc benzoate in the ink receiving layer of Example 1.

Example 9

The recording sheet for an ink jet printer of Example 9 was formed in the same manner as in Example 1, except that zinc acetate (produced by Wako Pure Chemical Industries, Ltd.) was used instead of zinc benzoate in the ink receiving layer of Example 1.

Comparative Example 1

The recording sheet for an ink jet printer of Comparative Example 1 was formed in the same manner as in Example 1, except that zinc benzoate was not used in the ink receiving layer in Example 1.

Comparative Example 2

The recording sheet for an ink jet printer of Comparative Example 2 was formed in the same manner as in Example 3, except that calcium hydrate, which is inorganic acid metallic salt, was used instead of zinc benzoate in the ink receiving layer of Example 3.

Comparative Example 3

The recording sheet for an ink jet printer of Comparative Example 3 was formed in the same manner as in Example 1, except that cationic dye fixing agent was not used in the ink receiving layer in Example 1.

Comparative Example 4

The recording sheet for an ink jet printer of Comparative Example 4 was formed in the same manner as in Example 3, except that a glossiness adjusting layer was not provided on the ink receiving layer in Example 3.

Subsequently, with regard to the recording sheets for an ink jet printer obtained in Examples 1 to 9 and the comparative recording sheets for an ink jet printer obtained in Comparative Examples 1 to 4, the objects for evaluation such as a color patch or the like were printed on these sheets, using an ink jet printer (trade name: PM-700C; produced by Seiko Epson Corporation), thereby obtaining excellent printing images. The recording sheet of Comparative Example 4 did not have glossiness, and was extremely inferior in appearance in comparison with the other recording sheets. Light resistance, ozone resistance, and ink absorptivity were evaluated by the below-described means using these printing images, and the results are shown in Table 1.

TABLE 1

| | Light Resistance 1 | Light Resistance 2 | Ozone Resistance | Ink Absorptivity |
|---|---|---|---|---|
| Example 1 | A | A | A | A |
| Example 2 | A | A | A | B |
| Example 3 | A | A | A | A |
| Example 4 | A | A | A | A |
| Example 5 | A | A | A | A |
| Example 6 | A | A | A | A |
| Example 7 | A | A | A | A |
| Example 8 | B | B | B | A |
| Example 9 | B | B | B | A |
| Comparative Example 1 | C | C | C | B |
| Comparative Example 2 | C | C | C | B |
| Comparative Example 3 | B | B | C | A |
| Comparative Example 4 | A | A | B | B |

Evaluation Means

1. Light Resistance 1

As an exposure test, each recording sheet for an ink jet printer which had printed thereon a magenta color patch was irradiated by UV radiation at 30 kJ/m$^2$ under these conditions (black panel temperature: 35° C.; relative humidity: 50%; emission of ultraviolet light at 340 nm: 0.35 W/m$^2$), using a xenon weather-o-meter (trade name: Ci-5000, produced by the Atlas Electric Devices Co.). The refraction density of the irradiated magenta color patch and the original were measured by a spectrophotometer (trade name: GRETAG SPM50; produced by Gretag Macbeth Corporation), and the light resistance 1 was evaluated according to the following criteria.

Remaining Ratio of Refraction Density

A: cases where the refraction density of the irradiated color patch was more than 90% of the original refraction density B: cases where the refraction density of the irradiated color patch was 80 to 90% of the original refraction density C: cases where the refraction density of the irradiated color patch was less than 80% of the original refraction density 2. Light Resistance 2

Each recording sheet for an ink jet printer which had printed thereon yellow, magenta, cyan, and black color patches was left near a windowpane facing south for about 2 weeks. Thereafter, the average of the remaining ratio of the refraction density was obtained by measuring the refraction density of these test color patches and the originals, using a spectrophotometer (trade name: GRETAG SPM50; produced by Gretag Macbeth Corporation), and the light resistance 2 was evaluated according to the following criteria.

Average of Remaining Ratio of Refraction Density

A: cases where the refraction density of the test color patch was more than 85% of the original refraction density B: cases where the refraction density of the test color patch was 70 to 85% of the original refraction density C: cases where the refraction density of the test color patch was less than 70% of the original refraction density 3. Ozone Resistance An environment having an ozone content of 10 ppm was prepared using a simple ozonizer, and each recording sheet for an ink jet printer on which was printed a cyan color patch was left in the environment for 10 hours. The refraction density of the tested cyan color patch and the original were measured by a spectrophotometer (trade name: GRETAG SPM50; produced by Gretag Macbeth Corporation), and the ozone resistance was evaluated according to the following criteria.

Remaining Ratio of Refraction Density

A: cases where the refraction density of the tested color patch was more than 85% of the original refraction density B: cases where the refraction density of the tested color patch was 70 to 85% of the original refraction density C: cases where the refraction density of the tested color patch was less than 70% of the original refraction density 4. Ink Absorptivity An N1 portrait image of ISO/JIS-SCID (according to Japanese Industrial Standard X9201-1995) having very fine Standard Color Image Data was printed on each recording sheet for an ink jet printer by an ink jet printer, and the ink absorptivity was evaluated by observing multicolor bleeding and unicolor bleeding thereon. The evaluation was performed by comparing the ink absorptivities of genuine glossy papers (trade name: glossy paper for super-fine (thick-type) photoprint paper; produced by Seiko Epson Corporation) by visual observation according to the following criteria.

Evaluation of Ink Absorptivity

A: cases where the problem in practical use was not observed at all and ink absorptivity is superior (equal to or greater)

B: cases where the problem in practical use was not observed and ink absorptivity is superior (it was slightly inferior, but differences in the SCID image were not observed)

C: cases where ink absorptivity was inferior in practice use (differences in the SCID image was observed)

As is apparent from the results of the above tests, the recording sheets for an ink jet printer according to Examples 1 to 10 showed that essential requirements such as printing density, vividness, and ink absorptivity are very superior, and further excellent properties were obtained in light resistance and ozone resistance. It was confirmed that these recording sheets for an ink jet printer scarcely undergo yellowing in long-term storage, and that they show superior water resistance and moisture resistance. In contrast, the comparative recording sheets for an ink jet printer according to Comparative Examples 1 and 2 were obviously inferior in light resistance and ozone resistance.

In addition to the above-described Examples, the recording sheets for an ink jet printer employing organic acid metallic salt such as oxalates, citrates, stearates of typical metallic elements such as strontium, barium, gallium, indium, thallium, germanium, tin, lead, bismuth, or the like instead of the zinc benzoate in Example 3, were confirmed to have the same effects.

What is claimed is:

1. A recording sheet for an ink jet printer, comprising at least an ink receiving layer and a glossiness adjusting layer in this order on a base material, wherein the ink receiving layer includes an organic acid metallic salt and a cationic dye fixing agent, the glossiness adjusting layer comprises a fine particle pigment and binder resin, and the organic acid metallic salt has a solubility in water such that not more than 25 g thereof dissolves in 100 g of water at 20° C.

2. A recording sheet for an ink jet printer according to claim 1, wherein the organic acid metallic salt comprises a divalent metal ion or trivalent metal ion.

3. A recording sheet for an ink jet printer according to claim 1, wherein the content of the organic acid metallic salt is 0.1 to 30% by weight to total solid content of the ink receiving layer.

4. A recording sheet for an ink jet printer according to claim 1, wherein the organic acid metallic salt comprises a metal ion chosen from Zn2+, Mg2+, and Ca2+.

5. A recording sheet for an ink jet printer according to claim 1, wherein the organic acid metallic salt comprises an anion chosen from benzoic ion, stearic ion, and oxalic ion.

6. A recording sheet for an ink jet printer according to claim 1, wherein the content of the binder resin in the glossiness adjusting layer is 1 to 150 parts by weight to the fine particle pigment of 100 parts by weight.

* * * * *